United States Patent [19]

Damiano

[11] 4,294,046

[45] Oct. 13, 1981

[54] TRAVELING TOOL CARRIER FOR SEVERING RAILWAY SPIKES

[76] Inventor: Luigi Damiano, 135 Farm St., Providence, R.I. 02908

[21] Appl. No.: 133,976

[22] Filed: Mar. 26, 1980

[51] Int. Cl.[3] ..... B24B 23/00

[52] U.S. Cl. ..... 51/170 R; 299/39; 83/928; 30/379; 104/1 R

[58] Field of Search ..... 51/178, 241 LG, 170 R; 83/488, 928; 30/379, 379.5, 166 R; 299/39, 38; 104/9, 17 R, 2, 1 R

[56] References Cited

U.S. PATENT DOCUMENTS

| | | | |
|---|---|---|---|
| 818,558 | 4/1906 | Prellwitz | 299/38 |
| 1,906,872 | 5/1933 | Perazzoli | 51/178 |
| 2,097,430 | 11/1937 | Brown | 30/379 |
| 2,223,732 | 12/1940 | Mall | 51/178 |

*Primary Examiner*—Roscoe V. Parker
*Attorney, Agent, or Firm*—Salter & Michaelson

[57] ABSTRACT

A traveling tool carrier is provided for severing the heads of railway spikes to facilitate the removal or replacement of the rails from the railway ties and bed. The traveling tool carrier includes a platform that is mounted for rolling engagement on the rails and has a saw support assembly mounted thereon in suspended relation. A saw that is formed as part of the saw support assembly is operated to engage and sever the heads of the railway spikes to provide for the convenient removal and replacement of the rails. The saw support assembly is both horizontally and vertically adjustable on the platform to locate the saw in the required position for severing the spike heads.

10 Claims, 6 Drawing Figures

TRAVELING TOOL CARRIER FOR SEVERING RAILWAY SPIKESBACKGROUND OF THE INVENTION

Since many of the rails that now comprise part of the present day railway system are either unduly worn or are located on a railway bed that does not provide the proper support for the rails, a program has been initiated to replace the rails and refurbish the rail beds. Replacement rails have included so-called "ribbon rails" and the like; but before the replacement rails can be installed on the railway bed, the old rails must first be removed therefrom.

The rails as mounted on a railway bed are normally held in place by the heads of spikes that are fixed to the railway ties, the spikes extending through plates that are located on the railway ties adjacent to the rails. In order to remove the rail spikes that extend through the plates, it has been the practice heretofore to pry the railway spikes out of the ties, which then enables the rails to be lifted from the railway ties. The prior known equipment for removing the rail spikes has normally consisted of pry bars that are difficult and laborious to use; and although they have accomplished the purpose of removing the spikes from the ties, the labor costs and time expended have been excessive. Although several mechanical systems have been attempted for removing the railway spikes from their inserted position, the only practical solution, prior to the instant invention, has been the manual prying of the spikes from the ties to release the rails for removal.

The present invention solves the problem hereinabove discussed in removing the railway spikes from their engaging position with respect to the rails; and prior to the instant invention, applicant is unaware of any machine or method that accomplished the purpose as will be hereinafter set forth. In this connection, the best prior art known to applicant that pertains to apparatus for use on a rolling platform or for use in connection with working on railway roadbeds is described in the following U.S. Pat. Nos. none of which show or disclose the subject matter of the present invention: 959,142, HURD; 1,067,076, TAPP; 1,108,718, DAWSON; 1,119,886, SEVERSON; 1,651,101, PAYS; 2,316,747, STEPHENS; 2,598,048, GILMORE; 3,144,835, PEHOSKI et al; and 3,967,396, MAISONNEUVE et al.

SUMMARY OF THE INVENTION

The present invention relates to a traveling tool carrier for severing heads of railway spikes prior to removal or replacement of railway rails from ties as located on a rail bed. The traveling tool carrier comprises a platform having front and rear wheels mounted on the underside thereof for rolling engagement with the rails. A support is located on the platform and a vertical adjustment assembly is mounted on the support, a horizontal adjustment assembly also being secured to the vertical adjustment assembly for vertical movement therewith. Mounted on the horizontal adjustment assembly for movement therewith is a saw support assembly, the saw support assembly including a rotating saw that is suspended therefrom and disposed such that the axis thereof is inclined to the vertical. The location of the saw is such that the saw is angularly engageable with the heads of the railway spikes upon traveling movement of the platform. In order to locate the saw in the appropriate angular position so that it completely severs the spike heads upon the traveling movement of the platform, the saw support assembly is vertically and horizontally adjusted by appropriate means mounted on the vertical and horizontal assemblies. The platform also carries thereon means for rotating the saw for severing the spike heads as the platform is moved forwardly on the rails.

Accordingly, it is an object of the present invention to provide a traveling tool carrier for movement over railway rails and that carries an ajustable rotating saw that severs the heads of railway spikes so that the rails secured to the rail ties by the spikes may be easily removed and replaced.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
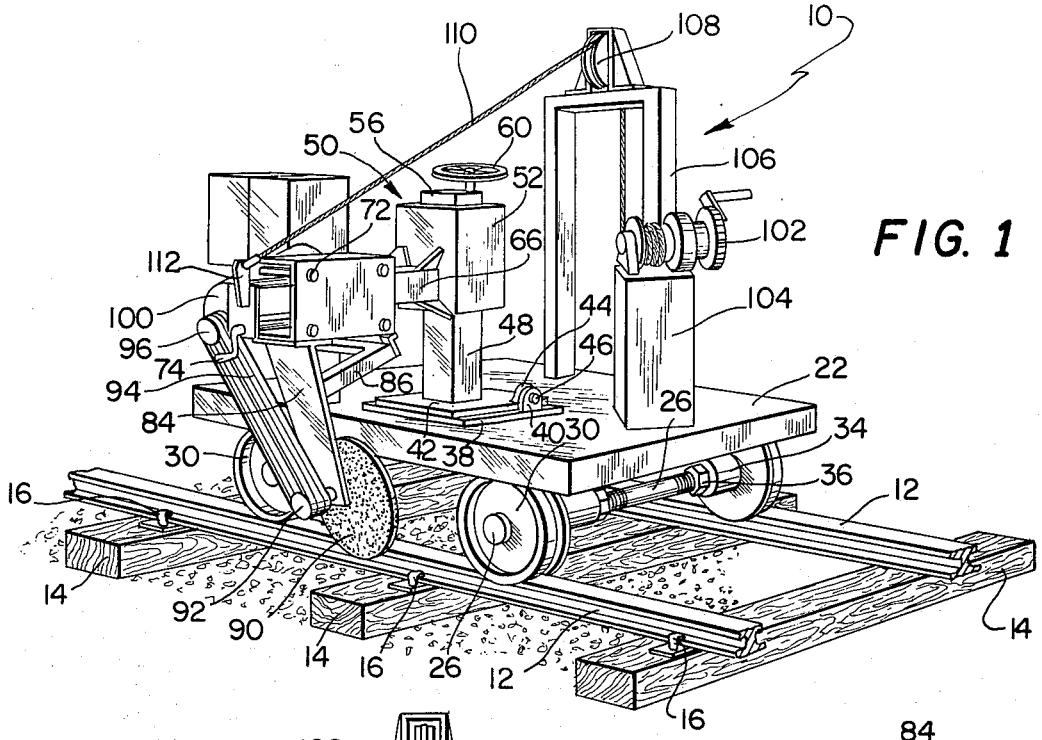
FIG. 1 is a perspective view of the traveling tool carrier as located on railway rails for movement thereover during a spike severing operation.

Referring now to the drawings and particularly to FIG. 1, the traveling tool carrier embodied in the present invention is illustrated and is generally indicated at 10. As will be described, the traveling tool carrier 10 is provided for the purpose of severing the heads of rail spikes that extend through rail plates and that secure railway rails in position on underlying railway ties. In this connection, and referring to FIGS. 1 and 4, conventional railway rails are indicated at 12 and are secured to railway ties 14 that extend transversely with respect thereto, the railway ties 14 being located on a railway bed in the usual manner. The rails 12 are secured to the ties 14 by rail spikes 16 that extend through openings formed in tapered plates 18. The plates 18 are located on the ties 14 adjacent to the rails 12, and a head 20 of each spike 16 overlies a lower flange of the adjacent rail 12. Since the shank of the spike 16 extends into the tie 14, the head 20 as it overlies the adjacent flange of the rail 12, secures the rail 12 on the tie 14.

When it is necessary to remove the rail 12 from the tie 14, the spikes 16 must be withdrawn from their impaled positions. Prior to the instant invention, the spike 16 was usually pried loose from the tie 14 by lifting the spike head 20 upwardly by a pry bar or the like that was inserted thereunder. However, since this is somewhat of a laborious task, the end result of releasing the rail can be more easily and simply accomplished by merely severing the head 20 of the spike 16 from the shank thereof. Thus, it is seen that by severing the head 20 from the spike shank, the rail 12 will be released from engagement with the tie 14.

Figure 2:
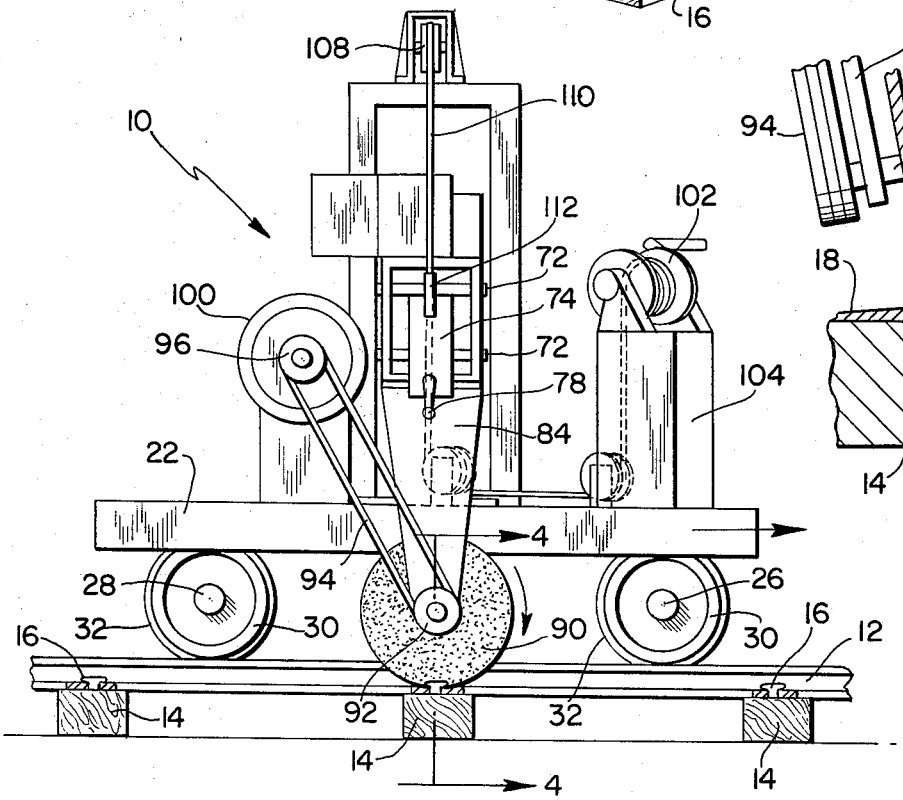
FIG. 2 is a side elevational view of the traveling tool carrier illustrated in FIG. 1.
Figure 3:
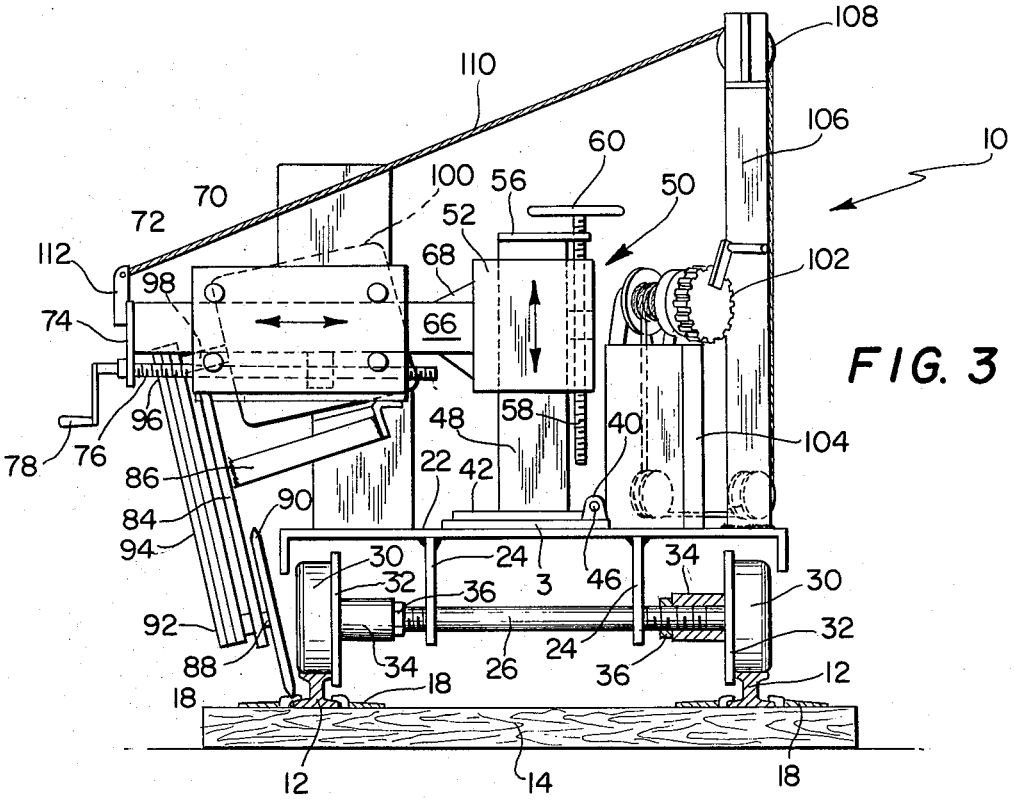
FIG. 3 is an end elevational view thereof.

Referring now to FIGS. 1–3, the traveling tool carrier 10, which as described herebelow is designed to provide for the severing of heads 20 from the spikes 16, is shown mounted on the parallel rails 12 and includes a platform 22 on the underside of which axle supports are mounted. As shown in FIG. 3, axle supports 24 project downwardly from the underside of the platform 22 in spaced relation and receive a front axle 26 in appropriate openings formed therein. Although not shown, rear axle supports are also joined to the underside of the platform 22 and receive a rear axle 28 therein. As illustrated more clearly in FIG. 3, the axle 26 extends through wheels 30, each of which is formed with an interior flange 32 and an interior hub 34 thereon. Threaded portions are formed on the outer ends of the axle 26, and adjustment nuts 36 are threadably received on the threaded portions of the axle 26, the adjustment nuts abutting against the outermost ends of the hubs 34, thereby positively locating the flanges 32 of the wheels 30 against the inner edges of the rails 12. It is seen that the adjustment nuts 36 insure that the wheels 30 will remain in positive engagement with the rails 12 during the rolling movement of the traveling tool carrier thereover.

Secured to the upper surface of the platform 22 is a base member 38 on which a trunnion 40 is mounted. A base plate 42 to which a trunnion 44 is fixed is located on the base member 38, a pivot pin 46 extending through the trunnions 40 and 44 and providing for pivotal movement of the base plate 42 relative to the base member 38. Fixed to the base plate 42 and supported thereby is a vertical standard 48 that is substantially square in cross section; and as will be described, the adjustment assemblies for adjustably supporting a saw that severs the spike heads 16 are mounted for vertical and horizontal movement on the support 48 and are also pivotally movable therewith from an operative to an inoperative position when the tool carrier is not in use.

Figure 5:
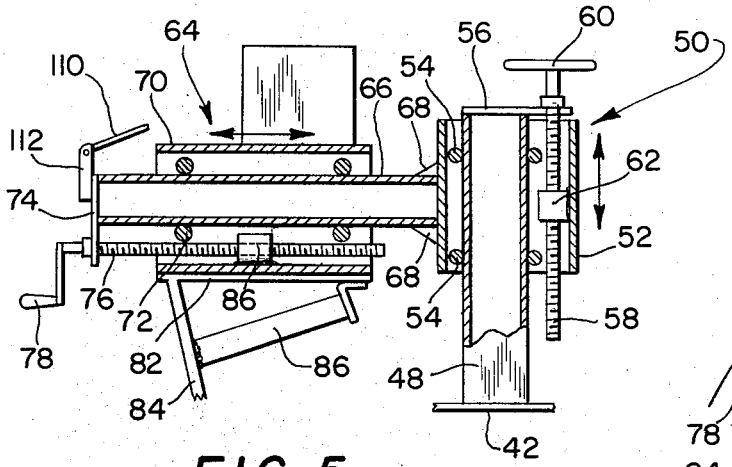
FIG. 5 is a sectional view showing the vertical and horizontal adjustment assemblies for the saw support assembly.

As shown in FIGS. 1, 3 and 5, a vertical adjustment assembly generally indicated at 50 is mounted on the support 48 and includes a tubular sleeve or housing 52 through which horizontal rollers 54 extend, the rollers 54 engaging opposite exterior walls of the support 48 to provide for easy vertical movement of the assembly 50 on the support 48. Located at the uppermost end of the support 48 is a top plate 56 that extends beyond the outer wall of the support 48, the top plate 56 being provided with an opening therein through which a threaded shaft 58 extends. An adjustment hand wheel 60 is secured to the uppermost end of the adjustment shaft 58; and, as will be described, is rotatable to provide for the vertical adjustment of the assembly 50. An inner collar or tubular bracket 62 is secured to the interior wall of the tubular housing 52 and receives the shaft 58 in threaded relation therein. Thus, it is seen that upon rotation of the shaft 58 by the hand wheel 60, the tubular housing 52 will be moved in a vertical direction with respect to the vertical support 48.

Secured to the tubular housing 52 and extending horizontally with respect thereto is a horizontal adjustment assembly generally indicated at 64. The horizontal adjustment assembly 64 includes a horizontal support member 66 that is joined directly to a wall of the tubular housing 52 by angled fins 68. Mounted on the horizontal support 66 is a horizontal tubular sleeve or housing 70 through which rollers 72 extend for engagement with opposite exterior surfaces of the support 66, wherein the housing 70 is easily movable on the support 66 as required. Secured to the outermost end of the horizontal support 66 is a plate 74 that extends downwardly therefrom and that is provided with an opening through which a horizontally threaded shaft 76 extends. An adjustment handle 78 is secured to the threaded shaft 76 and is rotatable for producing rotation of the shaft 76 as required. Fixed to the interior wall of the housing 70 is a threaded collar or bracket 80 that threadably receives the shaft 76 therein, wherein rotation of the shaft 76 produces a corresponding horizontal movement of the housing 70 with respect to the horizontal support 66.

Mounted on the underside of the housing 70 is a plate 82 to which an inclined support plate 84 is joined. Joined to the saw support plate 84 is an inclined angle bar 86 that is also interconnected to the underside of the support plate 82, the angle bar 86 securely locating the saw support plate in the inclined position thereof. As shown in FIGS. 1 and 3, a stub shaft 88 is journalled in the lowermost end of the saw support plate 84 in inclined relation and receives a circular saw 90 on the innermost end thereof, the plane of the saw 90 being inclined with respect to the vertical and with respect to the heads 20 of the railway spikes 16. Mounted on the outermost end of the stub shaft 88 are a pair of pulleys 92 on which driving belts 94 are received. The driving belts 94 also engage pulleys 96 that are located on an inclined drive shaft 98 that extends outwardly of a drive motor 100 that is conveniently mounted on a support member fixed to the platform 22. It is seen that upon operation of the motor 100, the drive shaft 98 is rotated to drivingly rotate the saw 90 through the drive pulleys 92 and 94. Although not shown, a conventional power unit for supplying the necessary power or for driving the motor 100 is also mounted on the platform 22, or is mounted on a trailing platform coupled to the platform 22.

Figure 4:
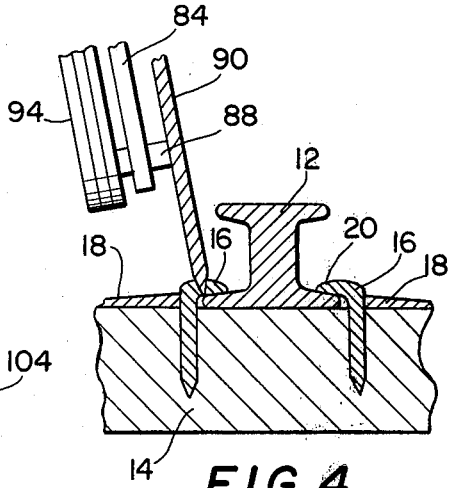
FIG. 4 is a sectional view taken along line 4—4 in FIG. 2.

In operation of the traveling tool carrier, the vertical support 48 is locked in the fixed vertical position as shown in FIGS. 1 and 3, and the hand wheel 60 is then rotated to adjustably move the tubular housing 52 to the proper vertical position for locating the saw 90 at the proper level relative to the heads 20 of the spikes 16. The hand wheel 78 is similarly rotated to move the tubular housing 64 in a horizontal direction on the support 66, the horizontal and vertical movements of the housing 64 locating the saw 90 in the appropriate cutting position as illustrated in FIGS. 3 and 4. After the adjustment of the horizontal and vertical adjustment assemblies 50 and 64 has been accomplished as indicated, the saw 90 is positioned such that upon traveling movement of the tool carrier 10 on the rails 12 the saw will sever the heads 20 of the spikes 16. Thus, as the tool carrier 10 is moved forwardly on the rails 12, operation of the motor 100 drives the pulleys 94 to rotate the saw 90 for accomplishing the severing action of the spike heads 20. After the heads of the spikes are severed that secure the particular rail sections to the ties, that rail may be lifted from the ties for replacement. It is also understood that a similar tool carrier as described will be utilized to sever the heads of the spikes securing the oppositely located rails to the ties.

Figure 6:
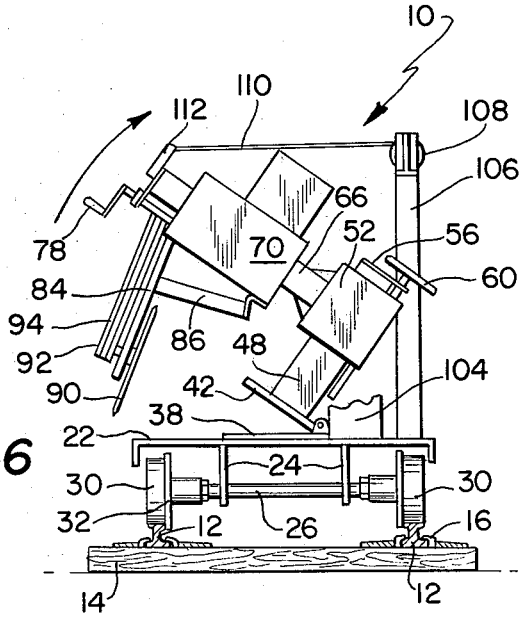
FIG. 6 is a reduced end elevational view showing the pivotal movement of the support and the assemblies as mounted thereon from the operative to the inoperative position thereof.

When the tool carrier is not operating to sever the heads of the rail spikes, the saw 90 is preferably moved to an inoperative position; and, as shown in FIGS. 1 and 6, this is accomplished by pivotally moving the vertical standard 48 as mounted on the base plate 42 on the pivot pin 46 and relative to the base member 38. In order to effect the pivotal movement of the vertical standard 48 on the base member 38, a winch indicated at 102 is provided and is mounted on a vertical support 104 that is secured to the forward end of the platform 22. An archway standard 106 is also secured to the platform, and mounted on the upper horizontal member of the archway standard 106 is an idler pulley 108 that receives a cable 110 that is wound around the pulley of the winch 102. The cable 110 is secured to a clip 112 that is fixed to the plate 74 of the horizontal support 66. Thus, when it is desired to retract the saw support assembly and the adjustment assemblies therewith, the winch 102 is operated to wind the cable 110 thereon, thereby retracting the assembly to the inoperative position as illustrated in FIG. 6.

Although not shown, the traveling tool carrier may be propelled by the power unit mounted thereon that drives the motor 100, or a separate car having its own drive can be coupled to the carrier for moving the carrier in the required direction.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A traveling tool carrier for severing heads of railway spikes prior to removal or replacement of railway rails, comprising a platform having front and rear wheels mounted on the underside thereof for rolling engagment with said rails, a support mounted on said platform, a vertical adjustment assembly mounted on said support, a horizontal adjustment assembly secured to said vertical adjustment assembly for vertical movement therewith, a saw support assembly mounted on said horizontal adjustment assembly for movement therewith, a rotating saw suspended from said saw support assembly and disposed such that the plane thereof is inclined to the vertical, wherein said saw is angularly engageable with said spike heads upon traveling movement of said platform, means mounted on said vertical and horizontal assemblies for vertically and horizontally adjusting said saw support assembly and the saw suspended therefrom in the angular operative position thereof, and means mounted on said platform for rotating said saw for severing the heads of said spikes as said platform is moved over said rails.

2. A traveling tool carrier as claimed in claim 1, said saw being supported exteriorly of said platform adjacent to a side thereof thereby providing for adjustment of said saw relative to said spike heads.

3. A traveling tool carrier as claimed in claim 1, said support being pivotally mounted on said platform, thereby providing for pivotal movement of the vertical support together with the horizontal adjustment assemblies to move said saw support assembly from an operative to an inoperative position.

4. A traveling tool carrier as claimed in claim 1, said vertical adjustment assembly including a vertical tubular housing that is mounted on said support in enveloping relation, said vertically adjusting means for said saw including means interconnected to said support for vertically adjusting said vertical adjustment assembly.

5. A traveling tool carrier as claimed in claim 4, said means interconnected to said support being defined by an adjustment shaft mounted on said support and a threaded bracket secured to said tubular housing and receiving said adjustment shaft in threaded relation therein, wherein rotation of said adjustment shaft produces a corresponding vertical adjustment of said vertical adjustment assembly relative to said support.

6. A traveling tool carrier as claimed in claim 4, said horizontal adjustment assembly including a horizontal support member that is mounted on the vertical tubular housing of said vertical adjustment assembly, a horizontal tubular housing mounted for sliding horizontal movement on said horizontal support, said horizontal adjusting means for said saw including a horizontal adjustment member mounted on said horizontal support member and threadably interengaging said horizontal tubular housing, wherein rotation of said horizontal adjustment member produces a corresponding horizontal adjustment of said horizontal tubular housing, said saw support assembly being secured to said horizontal tubular housing and being movable therewith.

7. A traveling tool carrier as claimed in claim 6, means mounted on said platform for pivotally moving said support including the horizontal and vertical adjustment assemblies from an operative to inoperative position.

8. A traveling tool carrier as claimed in claim 7, said means for pivotally moving said support including a first fixed support member secured to said platform, a pulley mounted on said first fixed support member, a second fixed support member mounted on said platform, a winch secured to said second fixed support member, the lowermost end of said support being fixed to a bracket that is pivotally mounted on said platform, and a cable interconnected to said horizontal adjusting assembly and to said winch through said pulley, wherein rotation of said winch produces a corresponding pivotal movement of said support and the horizontal and vertical adjustment assemblies that are mounted thereon for movement therewith.

9. A traveling tool carrier as claimed in claim 1, a front and rear axle mounted on the underside of said platform, said front axle receiving said front wheels for rotation thereon and said rear axle receiving said rear wheels for rotation thereon, and means mounted on said front and rear axles for positively locating said wheels on said rails and preventing inward axial movement thereof on said axles.

10. A traveling tool carrier as claimed in claim 9, each of said wheels including an inwardly directed hub that is mounted on the axle thereof, said locating means including a nut that is threadably mounted on said axle and that engages the hub of a wheel, wherein each of said wheels is prevented from inward axial movement on the axle thereof.

* * * * *